United States Patent [19]

Ward

[11] 4,116,415

[45] Sep. 26, 1978

[54] LINER FOR CONCRETE FORMS

[76] Inventor: Edward B. Ward, 820 Winchester, Kansas City, Mo. 64125

[21] Appl. No.: 789,451

[22] Filed: Apr. 20, 1977

[51] Int. Cl.[2] ..... E04G 11/12

[52] U.S. Cl. ..... 249/35; 52/576; 52/577; 249/83; 249/112; 249/188; 249/189

[58] Field of Search ..... 249/15, 16, 35, 112, 249/189, 83, 188; 52/576, 577, 221

[56] References Cited

U.S. PATENT DOCUMENTS

| | | | |
|---|---|---|---|
| 1,917,062 | 7/1933 | Reinhard | 249/112 |
| 3,759,481 | 9/1973 | Scott | 249/112 |
| 3,780,977 | 12/1973 | Dashew | 249/112 |

*Primary Examiner*—Francis S. Husar
*Assistant Examiner*—John McQuade
*Attorney, Agent, or Firm*—Fishburn, Gold & Litman

[57] ABSTRACT

A liner for concrete forms and method for making poured concrete walls comprises a liner body constructed of insulative material and shaped for positioning between a pair of interconnected form panels. The liner body has opposing sides, one of which is positioned abutting an interior surface of a first one of the panels. The other side of the liner body as a textured, decorative surface spaced from the other panels, and is contoured for molding concrete poured therebetween. A plurality of similarly shaped liner bodies are placed in a side-by-side relationship along the interior surface of each section of form panels, with the textured surface of each oriented inwardly. Unsolidified cementitous material, such as concrete, is poured into the cavity having a single insert therein or formed between opposing inserts, and is cured to a solidified state. The form panels are disassembled and removed, and the liners on the exterior side of the dried concrete wall are bodily separated therefrom, exposing a contoured, decorative aesthetic, optionally exterior surface portion. The liners on the interior side of the wall are securely attached to the wall, thereby forming an integrated wall structure.

27 Claims, 9 Drawing Figures

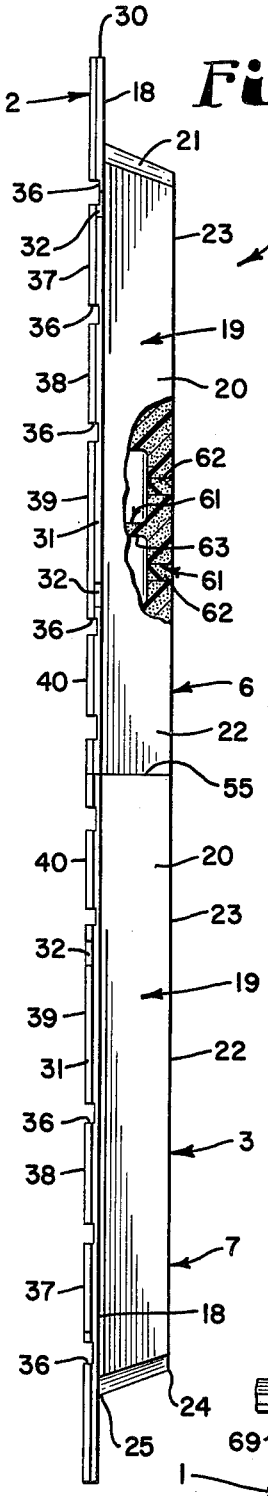
Fig. 3.
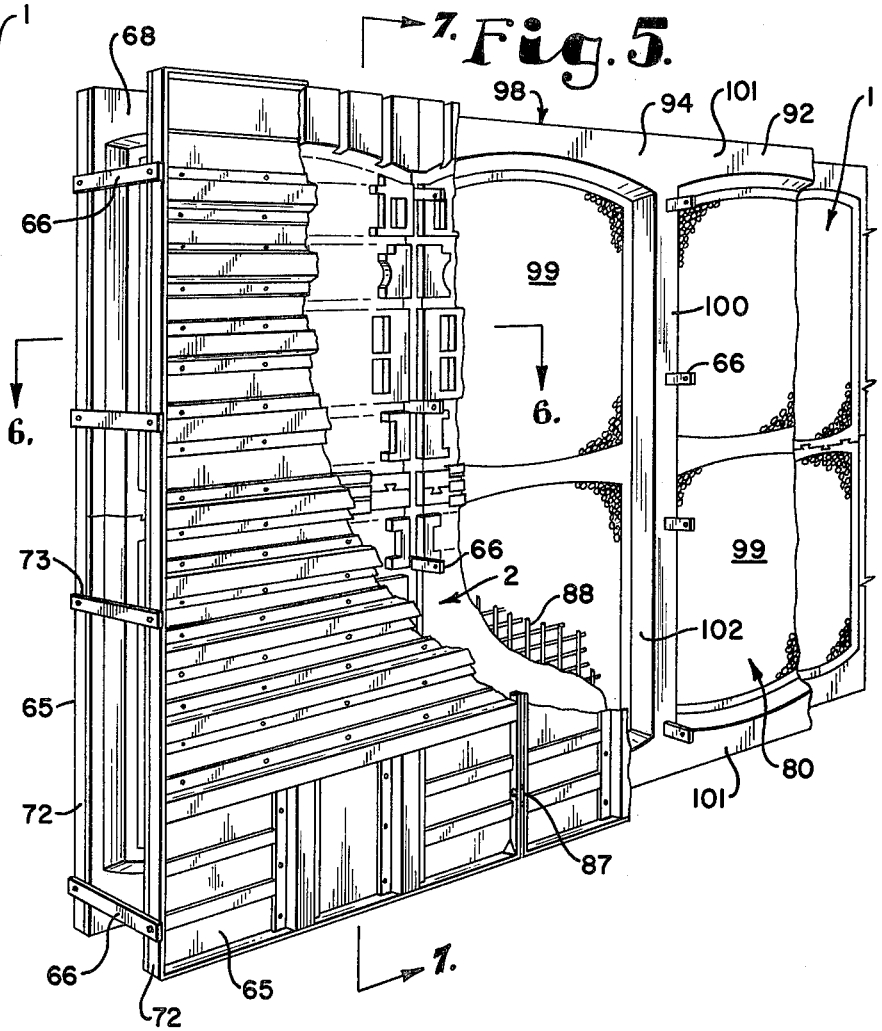
Fig. 5.
Fig. 6.
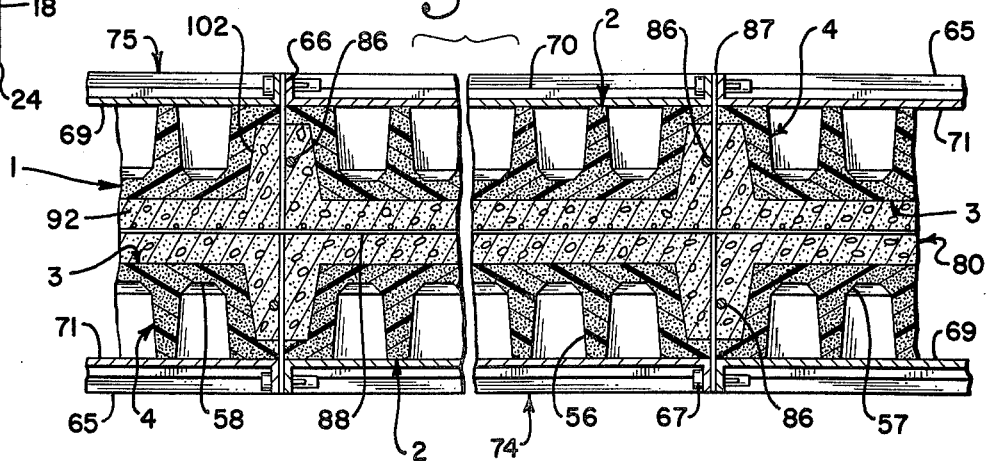

Fig. 7.
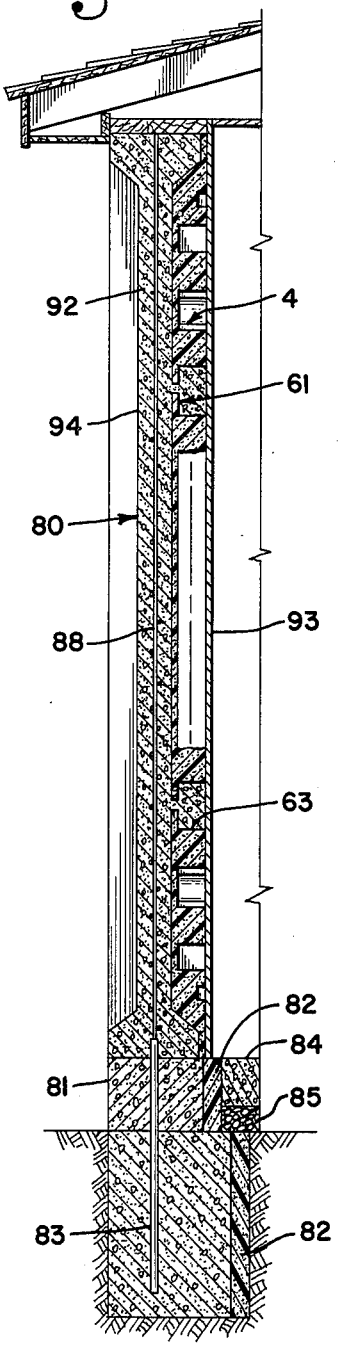
Fig. 8.
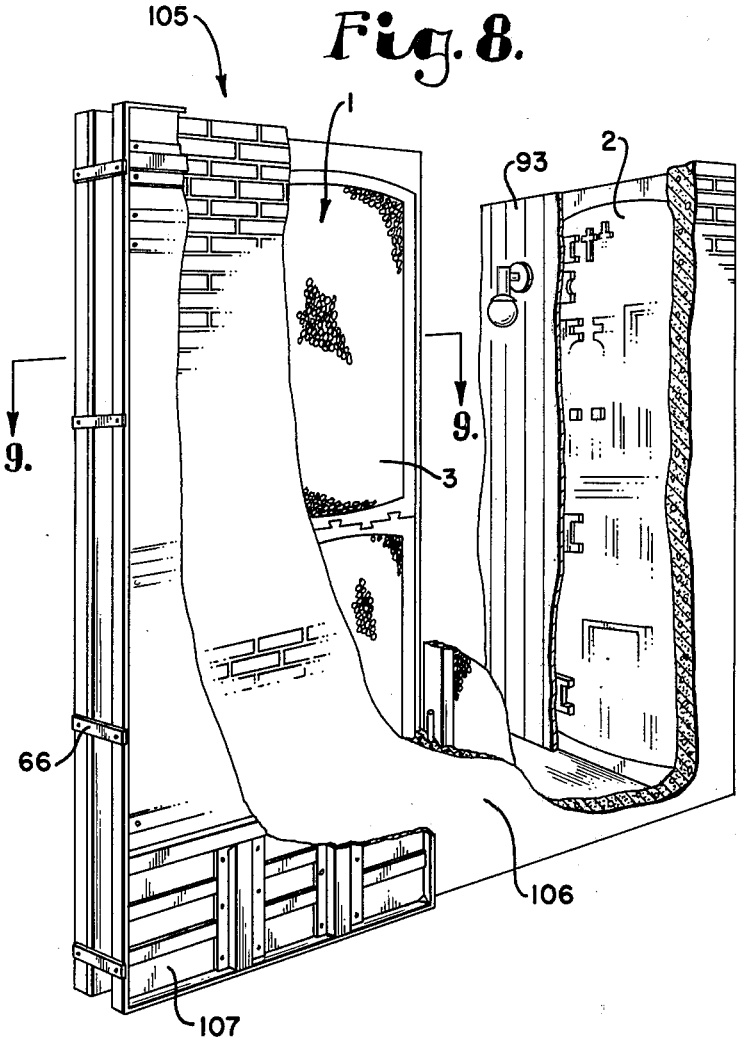
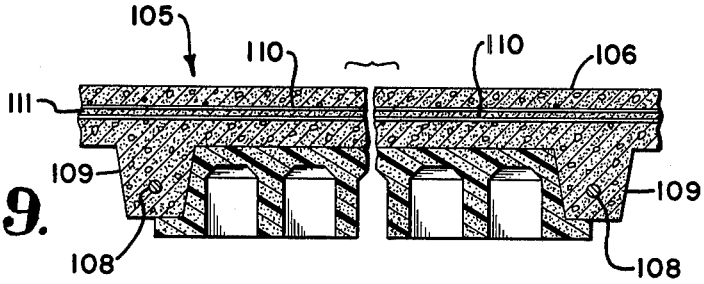
Fig. 9.

LINER FOR CONCRETE FORMS

This invention relates to forms for poured concrete walls, and in particular to a form and liner therefor, shaped for constructing aesthetically pleasing as well as insulated, poured concrete walls.

The principal objects of the present invention are: to provide a liner for concrete wall forms having a contoured side for molding a textured, decorative surface in the exterior side of the wall; to provide a liner constructed of insulative material for connection to the interior side of the wall for reducing the transmission of heat therethrough; to provide such a liner which is constructed of a material capable of being molded to achieve a plurality of esthetic patterns at an economical cost; to provide such a liner for positioning on either side of a pair of form panels for molding both sides of the wall and insulating one and/or both sides; to provide such a liner wherein each liner has an outwardly projecting medial portion which imparts an integral post and beam shape to the wall for greatly improved strength and reduced material cost; to provide such a liner for constructing monolithic building walls having structural integrity for resistance to high wind loads, earthquakes, and fire damage; to provide such a liner having means for providing anchoring apertures in the textured side of those liners abutting the interior form panels for securely and quickly fastening the liners to the wall; to provide such a liner wherein the other side thereof includes a plurality of recesses adapted to retain variously shaped utility fixtures and mechanical hardware therein for the efficient installation of building utilities and standard mechanical or electrical components; to provide such a liner comprising a pair of transversely interlocking halves for versatile application in variously shaped walls; and to provide such a liner which is economical to manufacture, efficient in use, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this disclosure and include exemplary embodiments of the present invention and illustrate various objects and features thereof.

FIG. 3 is a side elevational view of the liner with a portion thereof broken away.

FIG. 5 is a fragmentary perspective view of an assembly including a form, liners, and a wall constructed therefrom, the assembly having portions thereof broken away to show internal construction.

FIG. 6 is an enlarged fragmentary horizontal cross-sectional view of the assembly taken along line 6—6, FIG. 5.

FIG. 7 is a vertical cross-sectional view of the wall and a liner taken along line 7—7, FIG. 5, and is shown in conjunction with a building.

FIG. 8 is a fragmentary perspective view of another form, liner and wall arrangement embodying the present invention, having portions thereof broken away to show internal construction.

FIG. 9 is an enlarged fragmentary horizontal cross-sectional view of the wall and a liner taken along line 9—9, FIG. 8.

Figure 1:
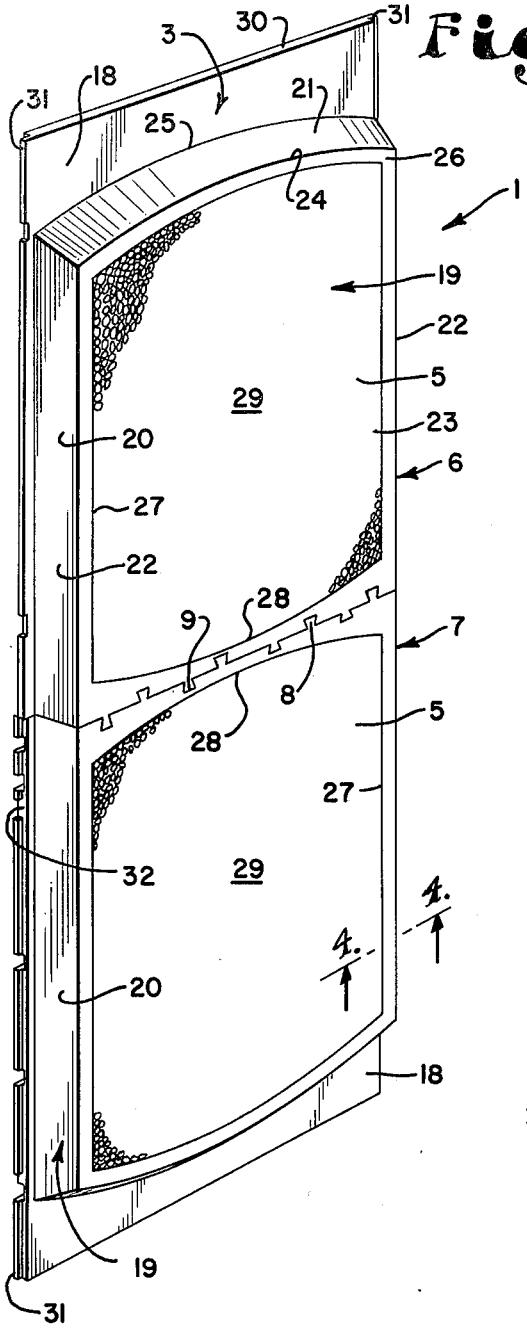
FIG. 1 is a perspective view of a liner for concrete wall forms embodying the present invention.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and is a representative basis for teaching one skilled in the art to variously employ the present invention in virtually any appropriately detailed structure.

The reference numeral 1 generally designates a liner for poured concrete wall forms embodying the present invention, shaped for positioning between a pair of interconnected form panels. The liner 1 has opposed sides 2 and 3, wherein the liner side 2 has a plurality of recesses 4 formed therein to retain variously shaped utility fixtures, and the liner side 3 has a textured decorative surface 5 for molding unsolidified cementitous material. The liner 1 is preferably constructed of a moldable, insulative substance, such as expanded synthetic resinous material, including Styrofoam, Polystyrene, urethane, or the like, and in this example, comprises a pair of transversely interlocking halves 6 and 7. The liner halves 6 and 7 have a substantially identical shape and are therefore interchangeable for improved economy as subsequently described. Means are provided for securely, yet detachably fastening the two liner halves together, and each of the illustrated liner halves 6 and 7 have a dovetail lock arrangement with tapered protuberances or tabs 8 and mating slots 9. The liner 1 may be provided with more than two interlocking portions for longer sections and/or have a modulated design to fit a maximum standard 48 inch mold machine.

Figure 4:
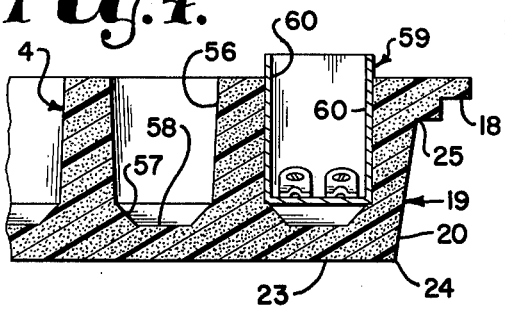
FIG. 4 is an enlarged fragmentary horizontal cross-sectional view of the liner taken along line 4—4, FIG. 1.

The textured liner side 3 is shaped for molding unsolidified concrete, and each liner half includes an outer, marginal base portion 18 and a central or medial portion 19. In the illustrated structure, the base portion 18 is flat and extends around the perimeter of the liner 1, and as best illustrated in FIG. 4, the medial portion 19 projects outwardly therefrom in the nature of the male element of a mold. Each of the medial portions 19 has a side wall 20 with an arcuately shaped end 21, a pair of rectilinear sides 22, and a top surface 23. The illustrated side wall elements 20 and 21 taper inwardly from the base portion 18 to the top surface 23, whereby the upper edge 24 of the medial portion is positioned interior of the lower edge 25, to facilitate the removal of the liner from solidified concrete. The top surface 23 has a smooth border portion 26 which originates along the upper edge 24 and extends inwardly therefrom to a substantially parallel edge 27. The central or inward side of each border portion 26 is defined by an arcuately shaped edge 28. An interior panel area 29 of the top surface 23 is defined by marginal edges 27 and 28, and in this example is textured or contoured in a decorative fashion to mold an esthetic pattern in the exterior surface of the poured concrete wall. The liner panel or liner area 29 may be molded to produce patterns of textured brick, smooth brick, flat smooth panels, a rock pattern, a rope reverse pattern formed by drawing a rope through the uncured cement, or any other similar design, and in this example, each liner area 29 has a pebble finish. Because a liner for a full height wall comprises two interconnected half sections 6 and 7, the various esthetic patterns may also be mixed to achieve a greater variety of desired appearances. The flat base portion 18 of the liner 1 includes end and side edges 30 and 31 respectively. In this example, each of the liner half side edge 31 includes a lip which matingly overlaps an abutting liner half, and a plurality of transversely positioned notches 32 which extend through the side edges, and are generally aligned. The purpose of the notches 32 will be subsequently described.

Figure 2:
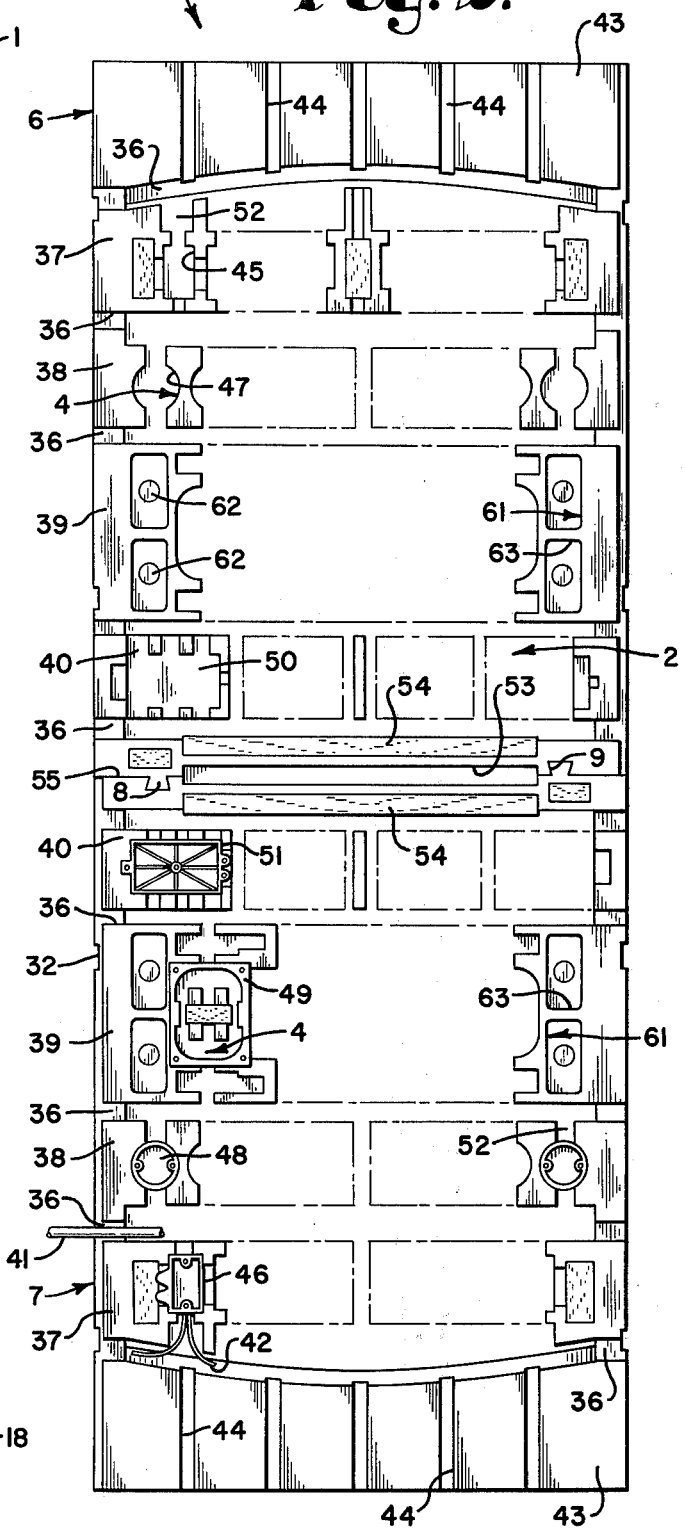
FIG. 2 is a rear elevational view of the liner, shown with various utility fixtures and mechanical and electrical hardware installed therein.

The other side 2 of the liner 1 is best illustrated in FIG. 2, and is provided with a plurality of recesses 4 for mounting utility fixtures therein. Each of the similarly shaped liner halves 6 and 7 includes a plurality of spaced apart channels 36 extending between the liner side edges 31 and forming fixture connecting areas 37, 38, 39 and 40 therebetween. Each of the channels 36 is shaped to receive and mount utility fixtures for the building therein, such as plumbing tubing 41, electrical wires 42, and the like, and permits the extension of the same through the liner to adjacently positioned liners. The outer end portions 43 of the liner side 2 includes a plurality of spaced apart, vertically aligned channels 44 therein which perform a similar function in permitting plumbing and wiring to be provided to an adjacently disposed building level, such as another floor, basement, or roof. It is to be understood that the precise shape and location of the recesses 4 will depend upon the type of building in which the liners are to be used, and the local building standards controlling construction in the area. In this example, each of the liner areas 37–40 includes a plurality of recesses or cavities 4 which are shaped for receiving and mounting therein a particular type of utility fixtures, such as apertures 45 for an electrical switch and/or duplex box 46 in area 37; a cavity 47 for electrical junction boxes 48 in the area 38; speaker mounts and/or nailing strip mounts 49 in the area 39; and apertures 50 for double boxes 51 for electrical wiring in the area 40. The apertures in each of the areas 37–40 are shaped in a slightly different manner to accommodate the various types of conventional fixtures available for installation therein. A plurality of vertically disposed channel sections 52 interconnect the transversely disposed channels 36 across each of the liner connecting areas 37–40 to facilitate ease of utility installation. Elongate cavities 53 are also dispursed about the liner side 2 and are shaped for mounting nailing strips 54 therein to facilitate nailing paneling and/or plasterboard to the interior surface of the wall, and are particularly positioned adjacent to the liner joint 55 for tile and wainscot installation. Each of the recesses 4 is preferably defined by inclined side walls 56, as illustrated in FIG. 4 and has diagonally shaped end corners 57 and a flat back portion 58. A utility fixture, such as illustrated electrical switch box 59 has parallel side walls 60 which engage the inclined recess side walls 56 and frictionally retain the same in the liner 1. The box 59 may be bonded to the liner 1 by means such as solvent, glue, or the like to achieve additional mounting security.

The liner 1 includes means for providing anchoring apertures in the textured side 3 of those liners abutting the form panels on the interior side of the wall. Unsolidified cement poured between opposing liners flows into and cures in the anchoring apertures 61, thereby securely fastening the interior liner with the inside of the wall. In this example, removable knock out plugs 62 are formed or positioned in inner end of each anchoring aperture, and are easily removable therefrom for use when the liner is positioned on the interior side of the wall. The illustrated anchoring apertures 61 extend from the textured side 3 of the liner inwardly to an enlarged recess 63 which communicates with the other liner side 2. The concrete which cures in said apertures has an enlarged head which positively and integrally connects the liner with the wall.

The liner 1 is adapted for positioning between a pair of interconnected form panels 65 (FIG. 5) with the liner side 2 abutting the interior surface of one of the panels, and the textured surface 3 facing the center of the form cavity. The liner 1 may be used in conjunction with conventional wood forms, and in this example, is shaped for use with prefabricated, permanent concrete form members which are interconnected by detachable latching means, such as the arrangement disclosed in U.S. Pat. No. 3,899,155 issued to E. Ward on Aug. 12, 1975. The form panels are provided in a predetermined size, generally 8 feet high and 3 feet wide, and are positioned in a side-by-side manner to form two spaced apart and substantially parallel sections. The form panels 65 are retained in position by transversely extending tie bars 66 and fastening devices 67, thereby forming a space 68 between opposed form wall sections into which cementitous material, such as concrete is poured. Each of the form panels 65 has a forward plate member 69 (FIG. 6) reinforced by rib members 70, and includes a smooth interior surface 71. The side 72 of each form panel 65 includes a plurality of transversely disposed notches 73 therein which mate with the liner notches 32 and provide an aperture through which the tie bars 66 extend. In the illustrated arrangement, one form panel 74 is positioned on the exterior side of the wall, and an opposed form panel 75 is disposed on the interior side of the wall. It is to be understood that where insulation is not desired, the interior liner may be removed and still achieve improved strength with reduced material.

A wall 80 poured from a form embodying the present invention is constructed on a suitable base material, such as a slab or the illustrated footing 81 (FIG. 7). The footing 81 is generally provided with insulation 82 on the interior side thereof, and rigid tie members 83 project from the upper surface of the footing. A concrete floor 84 poured over a rock filled base 85 may be installed subsequent to wall construction. The interior form panels 75 are first erected and interconnected on the footing 81. Metal reinforcing rods 86 are disposed vertically adjacent the interior form panels 75 and are spaced apart at each joint 87. The tie bars 66 are inserted through the notches 73 and are connected with the rods 86 by means such as a wire tie, welding or the like. It is to be noted that each of the reinforcing rods 86 is positioned at the joint 87, and is slightly off-center to avoid interference with the tie bars 66. If a half height wall is to be constructed, a single liner half 6 may be installed between the form panels, however, the tabs 8 thereon are first severed from the body of the liner. If a full height wall is to be constructed, two liner halves, such as 6 and 7, are interconnected by engaging the mating dovetail tabs 8 and grooves 9. The tabs frictionally interconnect the liner halves, which are then positioned against each of the interior form panels 75 with the recessed side 2 thereof abutting the interior surface 71 of the form panel. The sides 31 of adjacently disposed liners abut and form a seal therebetween to retain the wet concrete. The tie bars 66 extend through the notches 32 in the liner side edges and fit tightly therein thereby frictionally securing the liner in place. The knockout plugs 62 in the liners 1, which are positioned against the interior panel forms, have been removed prior to placement against the form panels. Wire mesh 88 is positioned longitudinally along the center of the cavity and wall and the tie bars 66 are inserted through the apertures thereof and may be attached to the wire mesh 88 to hold the same in place by means such as wire ties. A second set of the reinforcing rods 86 is positioned outwardly of the wire mesh and held in place by connection with the tie bars 66. The exterior liners with knockout plugs 62 intact are positioned with the textured side 3 thereof toward the center of the formed cavity, and the exterior form panels 74 are erected and interconnected to form the completed form structure. The exterior liners 1 are held in place by frictional engagement between the tie bars 66 and the side notches 32 thereof. Cementitous material, such as concrete, preferably having a good workability, is poured between the form panels 1, and the concrete gravitates or flows between the textured sides 3 of opposing liners 1 toward the bottom of the cavity 68 and through the apertures 61 into their associated recesses 63. The form is filled to the top and finished, and the concrete is cured to a solidified state. The fastening devices 67 are then loosened and the form panels 65 are disassembled and moved to the next job site. The exposed ends of the tie bars 66 may be made flush with each side of the wall to achieve a neat appearance.

The concrete 92 which has cured in the recesses 63 forms a secure anchor for attaching the liner 1 with the wall. The utilities, such as plumbing, wiring, gas and the like may then be installed in the wall channels and recesses, thereby avoiding the drilling of wood structures or the difficulties normally associated with installing utilities in buildings with poured concrete walls. Further, since the liner is constructed of an insulative material, the resistance of the wall to heat loss is greatly increased. The unused recesses 4 may be filled with insulative material such as glass fibers, or the like, or may be left empty to form dead air pockets which are sealed by the wall paneling 93. Also, a sheet of foil (not shown) may be bonded to the liner side 2 for more efficient insulation of the wall.

The liners 1 positioned on the exterior side of the wall are removed from the solidified cement to expose a textured decorative or aesthetic surface portion 94 shaped in accordance with the textured side 3 of the liner. A belt (not shown) may be placed about the center boundary portion 29 of the liner 1 prior to pouring the concrete to facilitate removal of the liner from the wall, and to prevent indentations from being formed in the wall by the dovetail locking arrangement. Since the liners are constructed of a soft, lightweight insulative material, they are easily deformed and/or dented during use and removal, and therefore constitute a type of temporary structure, as opposed to the relatively permanent form panels 65. However, because all of the liners are interchangeable, each liner only needs to be used once as a mold, thereby economically assuring consistent and true pattern reproduction, while at the same time providing an insulating barrier, and an attachment mechanism for utility fixtures. The exterior liners 1 are removed from the wall 80, then turned around by reversing the orientation of their sides, the knockout plugs 62 are then removed, and the liners are placed on the interior side of the next segment of wall to be poured. Each of the liners 1 is thus a multi-purpose structure which functions as a permanent insulator, an attachment device for utility fixtures, and as a temporary concrete mold with limited life expectancy. The liners positioned on the exterior side of the first wall segment of the building to be poured may be used as interior liners for a subsequently constructed walls or wall portion.

The insulated wall 80 constructed from a form embodying the present invention comprises a monolithic web wall having a plurality of integrally interconnected wall panels 98. Unlike prefabricated or precast concrete walls which are jointed, the present monolithic structure is without joints for increased strength. Each of the wall panels 98 has a post and beam design with an insulative liner 1 securely attached to the interior side thereof. The medial portion 19 of the liners form a web 99 between opposing members thereof and a column or post 100 on each side of the joint. The flat top and bottom portions 18 of the textured liner side 3 forms a beam 101 which is integral with each post. Each of the posts 100 is reinforced by a pair of rods 86 which extend longitudinally therethrough and are positioned near the geometric center of each protruding portion 102 of the post. Each pair of posts 100 is laterally interconnected by the tie rods 66. The wire mesh 88 extends through the center of each web 99, post 100, and beam 101 thereby reinforcing, and integrally interconnecting the same. The wall may be extended vertically by pouring additional wall sections (not shown) on top of the base structure to facilitate the construction of multi-story buildings. Each of the panels is preferably poured nearly simultaneously, thereby producing a monolithic web wall construction having greater strength to weight, and strength to cost ratio, requiring less raw materials (concrete, steel, etc.) and reduced construction time and labor by combining, consolidating, and simplifying crafts and skilled trades on erection and installation, and providing improved insulating characteristics.

The reference numeral 105 generally designates another embodiment of the present invention wherein, as best illustrated in FIGS. 8 and 9, the liners 1 are disposed on only the interior side of the wall, and thereby form a half-post-and-beam design therein. The exterior side 106 of the wall 105 is substantially planar, and in this example, is provided with a smooth brick surface formed by similarly contoured exterior form panels 107. The liners 1 are attached to the wall 105 in the manner previously described, and a single reinforcing rod 108 is positioned vertically in each wall half-post 109 adjacent the geometric center thereof. Two layers of wire mesh 110 extend through the center web of the outer portion 111 of the wall 105 and provide additional tensil and flexural strength therefor. The wall 105 is particularly adapted for use with buildings which do not require maximum wall strength, thereby permitting thinner walls and consequently reduced material cost, and/or buildings which require a substantially planar exterior appearance. Because the wall 105 is similar in design to the first described arrangement, like elements in the embodiments illustrated in FIGS. 1–7, and 8–9 respectively, are designated by the same respective reference numeral, unless specifically noted herein to the contrary.

It is to be understood that while I have illustrated and described certain forms of my invention, it is not to be limited to these specific forms or arrangement of parts herein described and shown.

I claim:

1. In a form for poured concrete walls having first and second panels positioned spaced apart to define a concrete receiving cavity therebetween, each of said panels having an interior surface, the improvement comprising:

(a) a first liner having a first side thereof abutting the interior surface of said first panel, and a second side thereof having a textured portion and being spaced apart from the interior surface of said second panel;

(b) a second liner having a first side thereof abutting the interior surface of said second panel, and having a second side thereof spaced apart from the second side of said first liner and forming an aperture therebetween for receiving unsolidified concrete therein, whereby unsolidified concrete is poured in said aperture and flows between the second sides of said first and second liners to form a poured concrete wall therebetween having a contoured, decorative exterior surface portion shaped in accordance with the textured second side portion of said first liner;

(c) means associated with the second liner for attaching the second side of said second liner with the interior surface of said wall; and (d) means positioned in the first side of said second liner for receiving and retaining utility fixtures therein.

2. An improvement as set forth in claim 1 wherein:

(a) said second liner has at least one removable plug therein which when removed forms a transverse aperture extending from the first to the second side of said second liner, such that concrete flows therethrough and cures to provide said means for attaching said second liner with the interior surface of said wall.

3. An improvement as set forth in claim 1 wherein:

(a) said receiving means comprises a plurality of recesses formed in said second liner first side; said recesses being adapted to retain variously shaped utility fixtures therein.

4. A liner for a poured concrete wall form having a plurality of interconnected panels which form a cavity in which unsolidified concrete is poured and cured to form a wall, said panels being disposed in a spaced apart relation to form exterior and interior sides of said wall, and said liner comprising:

(a) a body constructed of insulative material, having first and second sides, and being adapted for positioning in said cavity in first and second operational positions; and wherein (b) said body second side has a textured, decorative surface for molding and unsolidifed concrete;

(c) said body first side is shaped for placement abutting an inner surface of a form panel positioned on the exterior side of the wall in said first operational position, wherein the exterior surface of said wall is molded with a textured shape commensurate with said body second side; said liner being adapted to be bodily separated from said wall to expose the exterior wall surface;

(d) said body first side being also adapted for placement abutting an inner surface of a form panel positioned on the interior side of the wall in said second operational position, wherein said liner is connected with the interior surface of said wall and insulates the same;

(e) said second side of said liner includes a marginal edge portion and a medial portion projecting outwardly therefrom whereby said concrete wall has an integral post and beam construction; and (f) said first side of said liner includes a plurality of recesses formed therein and adapted to retain variously shaped utility fixtures therein.

5. In a form for poured concrete walls having interior and exterior form panels respectively associated with interior and exterior sides of the wall, and positioned spaced apart to define a concrete receiving cavity therebetween, each of said panels having an interior surface, the improvement comprising:

(a) a liner having a first side thereof abutting the interior surface of said interior form panel, and a second side thereof shaped for forming concrete and spaced apart from the interior surface of said exterior panel, whereby unsolidified concrete is poured into said cavity and flows between the second side of said liner and the interior surface of said exterior form panel to form a poured concrete wall therebetween having an outer surface portion shaped in accordance with the second side of said liner;

(b) means positioned in the first side of the liner for receiving and retaining utility fixtures therein; and means associated with the liner for fixedly attaching the second side of said liner to the interior surface of said wall for supporting said liner and said utility fixtures thereon.

6. An improvement as set forth in claim 5 wherein:

(a) said receiving means comprises a plurality of recesses formed in the liner first side; said recesses being adapted to retain variously shaped utility fixtures therein.

7. An improvement as set forth in claim 6 wherein:

(a) said liner has opposing end and side edges; and (b) said receiving means includes a channel extending between one of said edges and another of said edges, and is adapted to receive and retain an elongate utility member therein.

8. An improvement as set forth in claim 7 wherein:

(a) said channel intersects one of said recesses.

9. An improvement as set forth in claim 6 wherein:

(a) said recesses each have a pair of side walls which are inclined inwardly toward the liner second side for secure retention of said utility fixtures therein.

10. An improvement as set forth in claim 6 wherein:

(a) one of said recesses is shaped for receiving and retaining a nailing strip therein.

11. An improvement as set forth in claim 5 wherein:

(a) said liner is constructed of an insulative material for reducing the transmission of heat through said wall.

12. An improvement as set forth in claim 5 wherein:

(a) said liner has at least one removable plug which when removed forms a transverse aperture extending from the first to the second side of said liner, whereby during an operative condition wherein said plug is removed, concrete flows through said aperture and cures therein providing said means for fixedly attaching said liner with the interior surface of said wall.

13. An improvement as set forth in claim 5 wherein:

(a) said liner second side has a textured portion for forming a contoured, decorative exterior surface in said wall.

14. An improvement as set forth in claim 5 wherein:

(a) said liner constitutes a first liner; and including (b) a second liner having a first side thereof abutting the interior surface of said exterior panel, and having a second side thereof spaced apart from the second side of said first liner and forming an aperture therebetween for receiving unsolidified concrete therein.

15. An improvement as set forth in claim 14 wherein:

(a) said first and second liners have a substantially identical shape, whereby the same are interchangeable, and each is constructed of an insulative material.

16. An improvement as set forth in claim 15 wherein:

(a) said liners are constructed of an insulative material for reducing the transmission of heat through said wall; and (b) said second side of said second liner has a textured portion for forming a contoured, decorative exterior surface in said wall.

17. An improvement as set forth in claim 5 wherein:

(a) said liner comprises a pair of transversely interlocking half members; each of said half members having a substantially identical shape whereby the same are interchangeable.

18. An improvement as set forth in claim 17, wherein:

(a) said transversely interlocking half members each have a dovetail lock arrangement with tapered tabs and mating slots.

19. An improvement as set forth in claim 5 wherein:

(a) said second side of said liner includes a marginal edge portion and a medial portion projecting outwardly therefrom, whereby said concrete wall has an integral half-post-and-beam construction.

20. A liner for a poured concrete wall form having a plurality of interconnected panels which form a cavity in which unsolidified concrete is poured and cured to form a wall, said panels being disposed in a spaced apart relation to form exterior and interior sides of said wall, and said liner comprising:

(a) a body constructed of insulative material, having first and second sides, and being adapted for positioning in said cavity in first or second operational positions;

(b) means positioned in the first side of said liner for receiving and retaining utility fixtures therein;

(c) means positioned in the second side of said liner for attaching said liner to the interior side of said wall; and wherein (d) said body second side has a textured, decorative surface for molding said unsolidified concrete;

(e) said body first side is shaped for placement abutting an inner surface of a form panel positioned on the exterior side of the wall in said first operational position, wherein the exterior surface of said wall is molded with a textured shape commensurate with said body second side; said liner being adapted to be bodily separated from said wall to expose the exterior wall surface; and (f) said body first side is also adapted for placement abutting an inner surface of a form panel positioned to form the interior side of the wall in said second operational position, wherein said liner is adapted to be connected with the interior surface of said wall for supporting said utility fixtures thereon and insulating said wall.

21. A liner as set forth in claim 20 wherein:

(a) said body has at least one removable plug which when removed forms a transverse aperture extending from the first to the second side of said body, whereby in said second operational position, said plug is removed, and concrete flows through said aperture and cures therein providing said means for attaching said liner with the interior side of said wall.

22. A liner as set forth in claim 21 wherein:

(a) said transverse aperture has a second end thereof disposed at said body second side, and includes a portion enlarged from said aperture second end for forming an anchor to connect said liner with said wall.

23. A liner as set forth in claim 20 wherein:

(a) said receiving means comprises a plurality of recesses formed in the body first side; said recesses being shaped to retain variously shaped utility fixtures therein.

24. A liner as set forth in claim 23 wherein:

(a) said body has opposing end and side edges;

(b) said receiving means includes a channel extending between one of said edges and another of said edges, and is adapted to receive and retain an elongate utility member therein; and (c) said channel intersects one of said recesses.

25. A liner as set forth in claim 23 wherein:

(a) said recesses each have a pair of side walls which are inclined inwardly toward the body second side for secure retention of said utility fixtures therein.

26. A liner as set forth in claim 25 wherein:

(a) one of said recesses is shaped for receiving and retaining a nailing strip therein.

27. A liner as set forth in claim 20 wherein:

(a) said second side of said body includes a marginal edge portion and a medial portion projecting outwardly therefrom, whereby said concrete wall has an integral post-and-beam construction.

* * * * *